United States Patent [19]

Powers

[11] Patent Number: 4,909,171

[45] Date of Patent: Mar. 20, 1990

[54] SAILBOAT STOPPING SYSTEM

[76] Inventor: Richard A. Powers, 1213 St. Andrews Dr., Dunedin, Fla. 34698

[21] Appl. No.: 362,876

[22] Filed: Jun. 7, 1989

[51] Int. Cl.[4] ..... B63C 9/00; B63C 9/08

[52] U.S. Cl. ..... 114/144 C; 441/84; 441/80

[58] Field of Search ..... 114/144 R, 144 C; 441/80, 83, 84, 85, 108

[56] References Cited

U.S. PATENT DOCUMENTS

| | | | |
|---|---|---|---|
| 3,857,353 | 12/1974 | Mounce | 114/144 C |
| 4,040,374 | 8/1977 | Greene | 114/144 C |
| 4,599,073 | 7/1986 | Fryer et al. | 441/84 X |

*Primary Examiner*—Joseph F. Peters, Jr.

*Assistant Examiner*—Edwin L. Swinehart

*Attorney, Agent, or Firm*—Walter J. Monacelli

[57] ABSTRACT

The sailboat control device disclosed herein comprises one actuated by the pulling of a pin positioned therein, whose removal therefrom permits a spring controlled switch to be closed so that the position of the boat rudder is determined by the maneuvering of a wind vane on the boat. A line connected at one end to said pin and at the other end to the sailor on board causes the pin to be pulled or removed from the said device if and when the sailor should fall overboard. Movement of the wind vane and accompanying rotation of the vertical shaft to which it is attached effects movement of the rudder to make the boat travel in a direction not too far from where the sailor has fallen overboard.

9 Claims, 3 Drawing Sheets

SAILBOAT STOPPING SYSTEM

BACKGROUND OF THE INVENTION

1. Field of the Invention:

This invention relates to a device for stopping a sailboat in the event the sailor falls overboard. More specifically it relates to a device which is actuated by the pulling of a pin from the device. Still more specifically the pulling of the said pin permits the closing of a switch which adjusts positioning of the rudder of the sailboat. Still more specifically this pin is attached to one end of a line which is also attached at the other end to the sailor.

2. State of the Prior Art

When a sailor is the only person aboard a sailboat, he runs the risk that if he should fall or be swept overboard, the motion of the boat will take it away from the spot where the sailor falls into the water. Moreover if there is a strong wind, the sailboat's departure from this spot will be more rapid and in a single direction.

U.S. Pat. No. 4,807,343 describes boat safety apparatus for a motorized boat whereby the engine can operate as long as the operator is properly seated in the boat. When the operator leaves the seat, the boat's ignition circuit is automatically opened so that the driving means for the boat will be shut off.

U.S. Pat. No. 4,630,205 shows a system for controlling navigation of an engine-driven boat in which a radio transmitter is attached to the body of the operator of the boat which is adapted to transmit a signal to a radio receiver installed on board which receiver controls a command unit to stop the boat.

U.S. Pat. No. 4,743,213 is directed to a self-halt device for a water-jet, power-driven water craft. Here again the weight of the driver in the driver's seat is required for operation of the engine. When the operator leaves this seat, this condition effects a halt in the operation of the driving means for the craft.

Each of these disclosures is directed to devices for halting engine-operated or motorized boats. No means have been found in the literature for halting or rescue operation for a sailboat.

OBJECTIVES

It is an object of this invention to have the departure of a sailor, particularly a sole operator of a sailboat, to actuate the halting of the sailboat or avoidance of having the sailboat depart from the scene of the accident.

It is also an object of this invention to have a line attached to the operator of the sailboat which will actuate a control mechanism when the operator leaves the boat or in other words falls overboard.

It is also an object of this invention to have the said control mechanism control the rudder of the sailboat so as to keep it in the vicinity of the departed sailor.

It is also an object of this invention that the said control mechanism is directed by a wind vane which according to the direction of the wind controls the direction of movement of the sailboat.

These and other objectives as described hereinafter are capable of being met by the device of this invention.

STATEMENT OF THE INVENTION

In accordance with the present invention it has been found that the above objectives are fully met by operation of the device of this invention. This device comprises the combination of a line attached at one end to the operator or sailor of the sailboat and the other end is attached to a control means for opening or closing an electrical circuit for actuating a mechanism to operate the rudder of the sailboat when the said electrical circuit is closed. This line is long enough to allow the sailor to move the full length of the boat. However if the sailor falls overboard, the line triggers a means which closes an electrical circuit and puts into operation a system for controlling the right and left rudders of the boat in accordance with the direction of the wind.

In a preferred modification when the sailor's movement exceeds the length of the boat, or in other words the length of the line attached to his person, a pin attached to the other end of the line is pulled from the control mechanism. The removal of this pin releases a means for closing the electrical circuit, preferably a spring operated switch which closes the electrical circuit which in turn can function to actuate either the left or the right rudder in accordance with the direction of the wind which is affecting the sailing direction of the boat. The direction of the wind is read by a wind vane on a staff which projects vertically upward from the control device. As the wind vane is shifted in position in accordance with the wind direction, a rotation of the shaft on its linear axis is thereby effected. This shaft has attached at its lower portion a contact arm and a contact means which is capable under the appropriate directional circumstances to close one or the other of two electrical circuits, one of which causes the rudder motor to move the left rudder and the other of which causes the rudder motor to move the right rudder. The operation of the rudders is thereby controlled to maneuver the sailboat into a direction in which the wind will not make the boat move so that it will remain in the near vicinity of the sailor.

In addition to the above-described rudder control it may be described that the removal of the pin from the control device can also be used to effect the release of various safety devices such as a man overboard pole, a horseshoe ring, a life sling, etc. These may be attached to the pin or to an attaching device such as a ring attached to the pin. Moreover it may also be used to release over the side of the boat the end of a light line so connected to a block and tackle that the sailor may haul himself back on board the boat.

The device of this invention may be further described by reference to the drawings in which.

Figure 1:
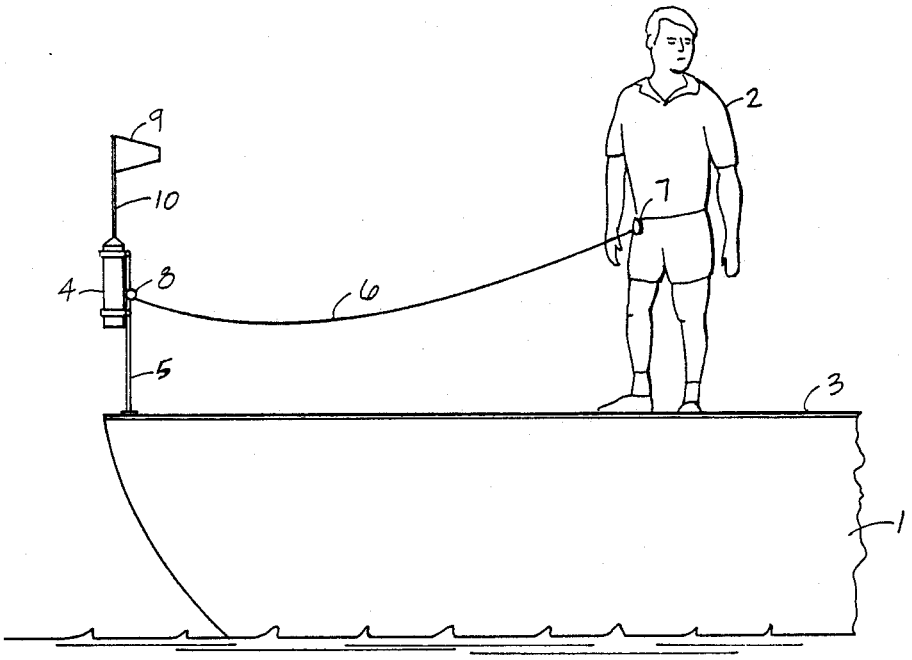
FIG. 1 is a side elevational partial view of a sailboat to which the control device of this invention is attached.

FIG. 1 is a side elevational partial view of a sailboat 1 showing the sailor 2 standing on the deck 3 with the control device 4 of this invention attached to a rail post 5. Line 6 is attached at one end to a retractable reel 7 fixed to the sailor's belt. The other end of the line is attached to ring 8 which is fixed to one end of a pin 11 (not shown in FIG. 1) which is inserted in control device 4. Windvane 9 is altered in position as it shifts to offer the least resistance to the wind. This variation in position is transmitted by staff 10 to the inside of device 4 where it actuates control of the boat's rudders.

Figure 2:
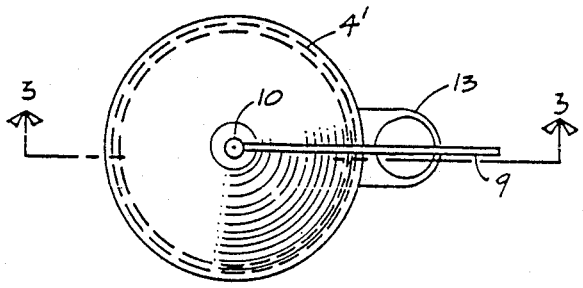
FIG. 2 is a top view of the control device of FIG. 1.

FIG. 2 is a top view of the control device of FIG. 1 shown without the pin and line of FIG. 1, but showing in dotted lines the outer shell 4' of control device 4 and clamp 13 which fastens the device 4 to rail post 5 shown in FIG. 1.

Figure 3:
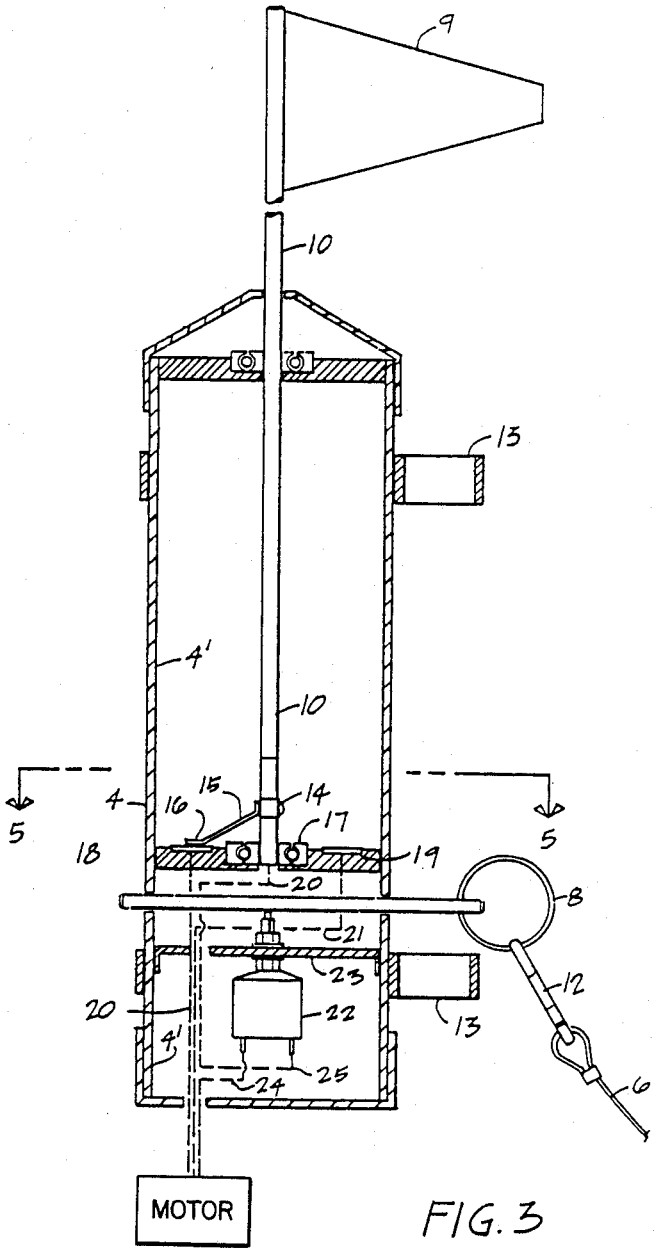
FIG. 3 is a cross-sectional elevational view taken at line 3—3 of FIG. 2.

FIG. 3 is a cross-sectional elevational view taken at line 3—3 of FIG. 2. Shaft 10 has at its lower end 10', tightly fastened thereto by clamp 14, arm 15 which holds contact 16. Wind vane 9 is always in line with the wind so as the wind direction changes this will cause a shift in the position of the wind vane and thereby rotation of shaft so as to cause a change in position of contact 16. Shaft end 10' is supported in ball bearing housing 17 so that little resistance is offered to the rotation of shaft 10 and also shifting of position of wind vane 9. When the contact 16 is in the position shown in FIG. 3, it is in touch or contact with a conductive contact element 18 preferably of brass embedded in a non-conductive material such as fiberglass plastic. In this position of contact an electrical circuit is closed by lead wire 20 with a motor (as shown in FIG. 3) adapted to operate the boat's rudders (not shown). A part of the electrical circuit comprises conductive arm 15, clamp 14, the lower part of shaft 10, housing 17 and lead wire 20'. In the position shown in FIG. 3, the electrical circuit is closed so that the motor operates one rudder, for example, the left rudder. When the change in position of the wind vane causes a shift in position of contact 16 so that it comes in contact with conductive element 19, electrical circuitry with the motor is completed by lead wire 21 so that the motor operates the other rudder, for example, the right rudder. In the lower portion of control device 4 there is positioned switch box 22 which is supported at its upper end by plate 23 which is welded or otherwise fastened to the interior of shell 4'. When the switch (not shown in FIG. 3) in switch box 22 is closed, lead wires 24 and 25 complete circuitry so that upon further completion of circuitry enabled by contact elements 18 and 19 with contact 16 the motor is actuated which controls operation of the rudder to turn it right or left.

Figure 4:
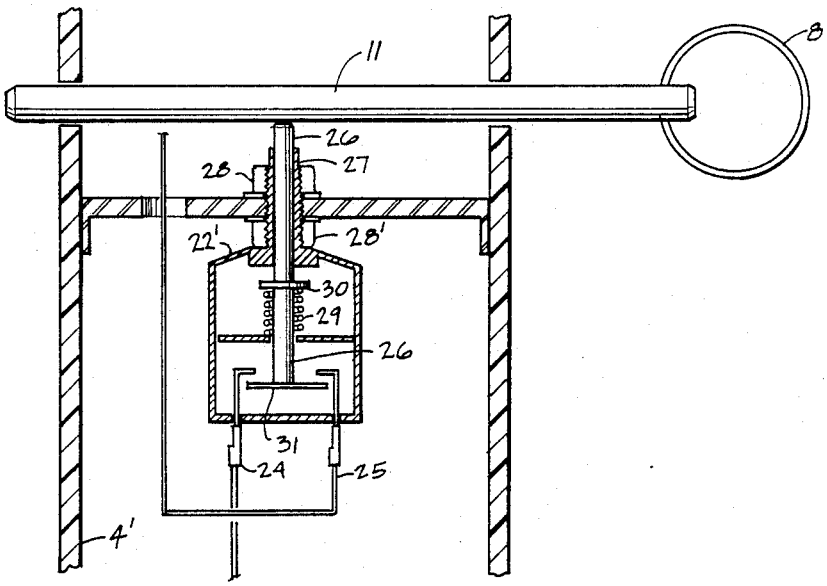
FIG. 4 is an expanded view of the portion of FIG. 3 showing the switch box and pin-actuating mechanism.

FIG. 4 is an expanded view of the switch box 22 and pin 11 showing the interior of the switch box. The switch elements comprise bar 26 which is supported in and free to ride up and down in sleeve 27 which is threaded and fitted by threaded sections 28 and 28' which hold sleeve 27 in position on plate 23. The top 22' of switch box 22 is affixed to section 28' or may be fixed directly to plate 23. Bar 26 is held in a down position by pin 11 in which position spring 29 is compressed. When pin 11 is removed, bar 26 is free to move upward and this is effected by the expansion of spring 29 which pushes abutment 30 upward and with it bar 26. The upward movement of bar 26 also causes the upward movement of metal plate 31 which comes in contact with the ends of lead wires 24 and 25 and thereby completes that part of the electrical circuit.

Figure 5:
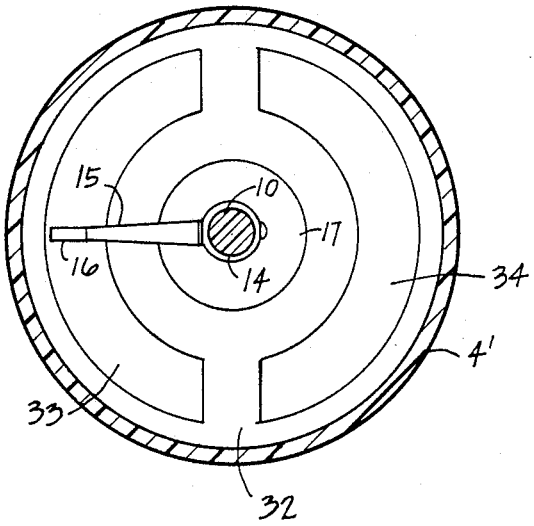
FIG. 5 is a downward view of the control device 4 taken at line 5—5 of FIG. 3.

FIG. 5 is a downward view of the control device 4 taken at line 5—5 of FIG. 3. Shaft 10 is shown in cross-section with clamp 14 holding arm 15 and contact 16 in position. Embedded in the background of non-conductive or insulating material, such as an epoxy resin impregnated with fiberglass, there are two semicircular contact sections 33 and 34 made of a conductive material, such as bronze, one being connected with the motor to move the left rudder and the other to move the right rudder. Since the path of contact 16 follows a circular pattern as it rotates about the axis of shaft 10, the design of conductive areas 33 and 34 is advantageously semicircular. Other shapes may also be used so long as they are separated by the non-conductive area 32 and provide the conductive area needed for contact with contact means 16.

The semicircular pattern referred to herein may be defined as the space between two semi-circles, the radius of one circle being shorter than the radius of the path of the contact means on the base plate and the radius of the other circle being larger than the radius of the said path of the contact means. The arc described by these semicircles are each less than 180°, advantageously by at least 10° at each end so as to provide sufficient area of non-conductive material between the two semi-circular segments.

The expression "line" has been used herein and is intended to mean any light rope that is strong enough for the pull required to release the pin but still light enough so as not to be a hindrance to the operator.

The device of this invention has utility only on a boat that is equipped with an electrical system for operation of the rudder. This generally means the presence of a battery which is periodically recharged from a power system on shore or by a generator on the boat.

As an illustration of how the system of this invention operates, it may be assumed that the wind is out of the north so that the wind vane will be pointing in a southerly direction. With the sailboat headed in a direction between 0 and 180 degrees (that is between North, East and South) the wind vane will cause the contact means 16 to be positioned on the conductive surface 33 which upon removal of the pin will complete the electrical circuit for turning the left rudder until the boat is in an upwind position. The contact means 16 will then move onto the non-conductive or insulated area 32. If the boat trys to sail away again, it will cause the contact means to move onto a conductive area and turn the boat upwind again.

In another situation with the wind out of the north and the boat headed between 180 and 360 degrees (that is between south, west and north) the wind vane will cause the contact means 16 to be positioned on the conductive surface 34 which upon removal of the pin will complete the electrical circuit for turning the right rudder until the boat is in an upwind direction. The contact means 16 will then move onto the non-conductive or insulated area 32. If the boat tries to sail away again, it will cause the contact means to move onto a conductive area and turn the boat upwind again.

In either of the above circumstances, the person in the water should be able to swim to the life sling and then to the boat and, with the aid of the rope attached to the block and tackle, pull himself into the boat.

In the event there is an auxiliary power system for operating the boat, such as a gasoline engine or a diesel engine, the removal of the pin can also serve to turn off the ignition for the gasoline engine or can operate a kill switch to stop the diesel engine. In both such cases the same rudder operation as described above is used to stop the sailboat from travelling.

In the drawings, indications of insulation of various components of the electrical circuits have been omitted to reduce the complexity of the drawings. However where insulation is needed to avoid undesired grounding or short circuiting the appropriate insulation is provided or where appropriate to make a connection to the ground side of a circuit the insulation may be omitted. In most cases the rudder operating circuit is run at 12 volts but any appropriate voltage may be used.

While certain features of this invention have been described in detail with respect to various embodiments thereof, it will of course be apparent that other modifications can be made within the spirit and scope of this invention, and it is not intended to limit the invention to the exact details insofar as they are defined in the following claims.

The invention claimed is:

1. A sailboat control system comprising the combination of:

(a) a line having a first end and a second end, said line being capable of being attached at said first end to the operator of said sailboat;

(b) a motor capable of effecting movement of the rudder of said sailboat;

(c) a control means for operation of said motor;

(d) a wind vane;

(e) a staff supporting said wind vane;

(f) an electrical circuit connected to said motor having a first open portion and a second open portion therein, the operation of said electrical circuit requiring the simultaneous closing of said first open portion and said second open portion; and (g) a flat base upon which said staff is supported at a 90° angle therewith, the upper surface of said flat base having two separate conductive areas embedded therein and separated from each other by a non-conductive area;

said control means for operation of said motor requiring the simultaneous closing of both said first open portion and said second open portion of said electrical circuit;

said second end of said line being attached to a closing means which upon a sufficient pull on the said line will effect a closing of the said first open portin of said electrical circuit;

said wind vane being rigidly affixed to the top end of said staff when said staff is supported in a vertical position with said staff being freely rotatable about its linear axis so as to permit the said wind vane to change position in accordance with any change in the direction of any wind to which the sailboat may be subjected;

said staff having attached thereto in its lower region a contact arm which has a contact means attached thereto riding on and in contact with the upper surface of said flat base, said contact means being a part of a wiring system that will upon contact with either of said conductive areas close said second open portion of said electrical circuit to operate said motor, the positioning of the said contact means on one of the said conductive areas of said flat base will actuate the motor to turn the said rudder to the left and the positioning of the said contact means on the other of said conductive areas will actuate the motor to turn the said rudder to the right.

2. The control system of claim 1 in which the closing means attached to the said second end of said line is a removable pin which when removed by the sufficient pull on said line will release a spring operated switch to close said second open portion of said electrical circuit.

3. The control system of claim 2 in which the said conductive areas are each made of bronze embedded in a non-conductive plastic.

4. The control system of claim 3 in which the non-conductive plastic is a resin impregnated with fiberglass.

5. The control system of claim 4 in which the said resin is an epoxy resin.

6. The control system of claim 1 in which said conductive areas are semi-circular in shape.

7. The control system of claim 2 in which said conductive areas are semi-circular in shape.

8. The control system of claim 5 in which said conductive areas are semi-circular in shape.

9. The control system of claim 2 in which said removable pin has a ring attached to which said line is attached.

* * * * *